US006863116B1

(12) United States Patent
Kane et al.

(10) Patent No.: US 6,863,116 B1
(45) Date of Patent: Mar. 8, 2005

(54) APPARATUS AND METHOD FOR COLLECTION AND DISPOSAL OF WASTE-WATER AND DEBRIS FROM HEAT EXCHANGER TUBES AND OTHER SOURCES

(75) Inventors: Timothy Kane, Greenwich, CT (US); Frank Intrieri, Jr., Riverside, CT (US)

(73) Assignee: Goodway Technologies Corporation, Stamford, CT (US)

( * ) Notice: Subject to any disclaimer, the term of this patent is extended or adjusted under 35 U.S.C. 154(b) by 0 days.

(21) Appl. No.: 10/816,281

(22) Filed: Apr. 1, 2004

(51) Int. Cl.[7] ..... F28G 13/00

(52) U.S. Cl. ..... 165/95; 165/119; 165/5; 15/3.52; 15/104.03; 15/104.05

(58) Field of Search ..... 165/5, 119, 95; 15/3.5, 3.52, 104.03, 104.05

(56) References Cited

U.S. PATENT DOCUMENTS 244,011 A * 7/1881 Weitzel ..... 165/95

FOREIGN PATENT DOCUMENTS

JP 4-52499 * 2/1992 ..... 165/95

* cited by examiner

*Primary Examiner*—Terrell Mckinnon
(74) *Attorney, Agent, or Firm*—Patrick J. Walsh

(57) ABSTRACT

A large flexible plastic bib that is conical or funnel shaped with its large open end supported by a frame for positioning near a source of effluent to be collected, and the bib small open end positioned to direct liquid and debris toward a floor drain.

9 Claims, 7 Drawing Sheets

APPARATUS AND METHOD FOR COLLECTION AND DISPOSAL OF WASTE-WATER AND DEBRIS FROM HEAT EXCHANGER TUBES AND OTHER SOURCES

BACKGROUND OF THE INVENTION

The present invention is directed to the art of cleaning the interior surface of heat exchanger tubes, and in particular to disposal of water and debris issuing from heat exchanger tubes in the course of cleaning the tubes. The invention may also be applied in the collection and disposal of liquids and related debris from building leaks, failed equipment and so forth.

In order to maintain thermodynamic efficiency in industrial and commercial shell and tube heat exchange equipment it is necessary periodically to clean the interior surface of the tubes. Commercially available tube cleaning machines utilize rotary brushes affixed to an end of a rotating drive shaft together with a stream of cleaning water. In use of the machine, the rotating brush with following water flow passes into and back out of each tube being cleaned. Each tube in a heat exchanger is individually cleaned in this manner.

When the rotating brush is withdrawn from a cleaned tube a column of water and debris exits the tube ahead of the brush splashing down the tube sheet and spilling onto the heat exchanger support beams as well as on the floor below the heat exchanger. Heat exchanger tubes are cleaned as desired but a mess results outside the heat exchanger.

There is need for efficient collection and disposal of water and debris removed from heat exchanger tubes in a tube cleaning operation.

The present invention is directed to an apparatus and method for collecting water and debris exiting from cleaned tubes and for directing such water and debris to a floor drain or sewer.

In other applications, the invention may be used for collection and disposal of fluid and related debris when leaks occur, or equipment fails and so forth.

SUMMARY OF THE INVENTION

In accordance with the apparatus and method of the present invention, water and debris exiting a tube ahead of a cleaning brush are collected in a large flexible plastic bib that is conical or funnel shaped with its large open end positioned near the tubes and its small open end positioned to direct water and debris toward a floor drain. In a preferred arrangement of the invention, the bib is mounted on a rectangular frame to set-up and maintain its collection opening in front of a heat exchanger tube sheet so as to catch and dispose of tube cleaning water and debris forced from each tube as a cleaning brush is extracted from the tube. The frame is provided with mounting means preferably in the form of spaced elongate brushes affixed to a side of the frame. The plastic collection bib and is positioned relative to tube ends by inserting the spaced brushes into a heat exchange tube so as to position the collection bib opening more or less centrally of a section of tubes being cleaned. The bib and its mounting frame are moved from position to position along the tube sheet until the all of the heat exchanger tubes are cleaned. When so positioned the collection bib catches water and debris exiting from the tubes and drains the water and debris to a floor drain adjacent the heat exchanger.

In this way most of the cleaning water and debris are disposed of minimizing the need for cleaning the tube sheet, heat exchanger support beams and the floor below the heat exchanger.

In a modification of the invention, the collection bib and frame are mounted on a moveable stand for placement so as to collect liquid and debris from leaks and drainage of various kinds, and to lead collected material to a suitable drain for disposal.

In another modification of the invention, the collection bib is provided with a deflector panel extending from the rim of the bib and secured to the top side of the heat exchanger for deflecting liquid and debris down into the bib. This modification of the invention is primarily for use at the back side of the heat exchanger where liquid and debris are pushed out of each tube, however, the modification can also be used at the front side of the heat exchanger where an operator is cleaning tubes.

In another modification of the invention, a collection bib is fitted with an integral deflector hood that is fitted over an exposed tube sheet for deflecting tube effluent down into the bib. This modification is chiefly used at the back side of the heat exchanger.

Specific examples are included in the following description for purposes of clarity, but various details can be changed within the scope of the present invention.

OBJECTS OF THE INVENTION

An object of the invention is to provide an apparatus for collecting and draining away waste-water and debris in a tube cleaning operation.

Another object of the invention is to provide a method for collecting and draining away waste-water and debris in a tube cleaning operation.

Another object of the invention is to provide an apparatus to be positioned as desired on a heat exchanger tube sheet for collecting and draining away waste-water and debris exiting each tube in a cleaning operation.

Another object of the invention is to provide for convenient collection and disposal of liquid and debris from leaks of various kinds as well as the removal of same from failed equipment and so forth.

Another object of the invention is to provide an apparatus to be positioned on the front side and on the rear side of a heat exchanger tube sheet for collecting and draining away waste-water and debris exiting front and rear ends of each tube in a cleaning operation.

Other and further objects of the invention will become apparent with an understanding of the following detailed description of the invention or upon employment of the invention in practice.

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE PREFERRED EMBODIMENT

Figure 1:
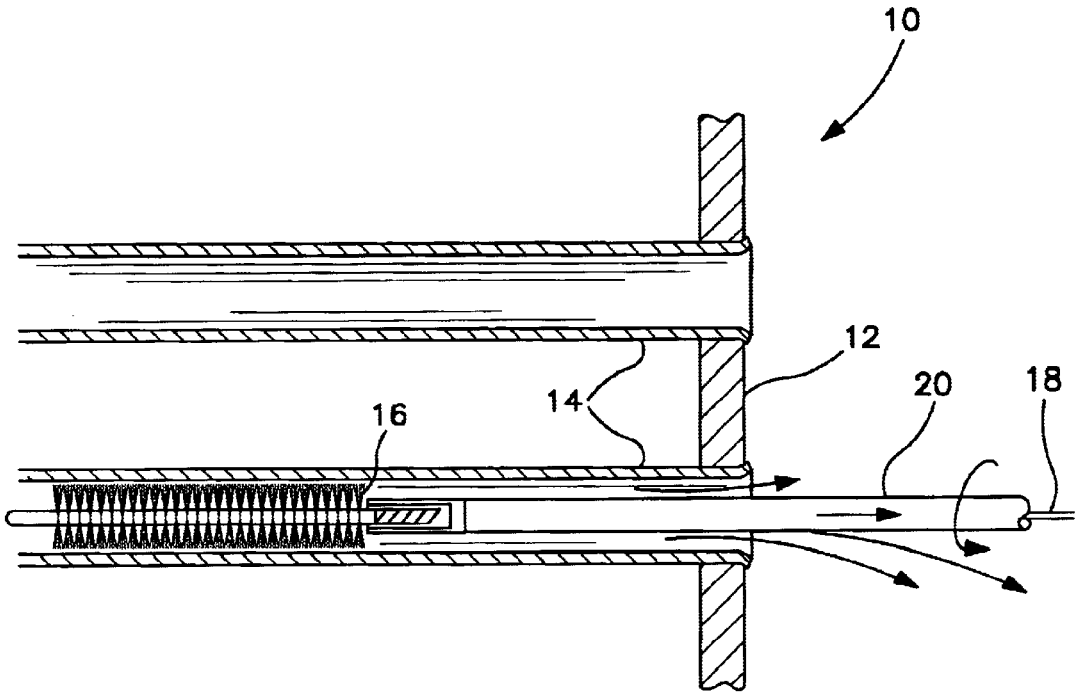
FIG. 1 is a schematic view partially in section showing a tube cleaning operation for a shell and tube heat exchanger in which a rotating cleaning brush ejects a column of water and debris from the tube as the brush is being withdrawn from the tube.

Referring to the drawing, a shell and tube heat exchanger 10 for commercial and industrial use includes spaced tube sheets 12 supporting the ends of heat exchange tubes 14. The tubes are cleaned by a rotary brush 16 mounted at the end of rotating drive shaft 18 covered by an outer sheath 20. The rotary brush is inserted into each tube with a water flush moving down through the tube to its far end in a cleaning pass, and then being withdrawn by reverse rotation back through the tube. As the brush approaches the near end of the tube, a column of waste flushing water and debris is ejected from the tube for disposal.

An apparatus 22 according to the invention for collection and disposal of waste water and debris during a tube cleaning operation comprises a large flexible impermeable plastic bib 24 in the general shape of a funnel with large entry opening 24*a* situated below the tube sheet, and with conical body 24*b* converging into an elongate duct 24*c* leading waste water and debris to a sewer or drain pipe.

A major portion of the large end of the bib has triangular flaps 24*d* for securing the bib to a supporting frame 26 which sets up and maintains the large end of the bib in wide open position. The remaining portion of the large end of the bib is defined by a generally straight edge 24*e* for positioning under a tube sheet so as to collect ejected waste water and debris.

Figure 2:
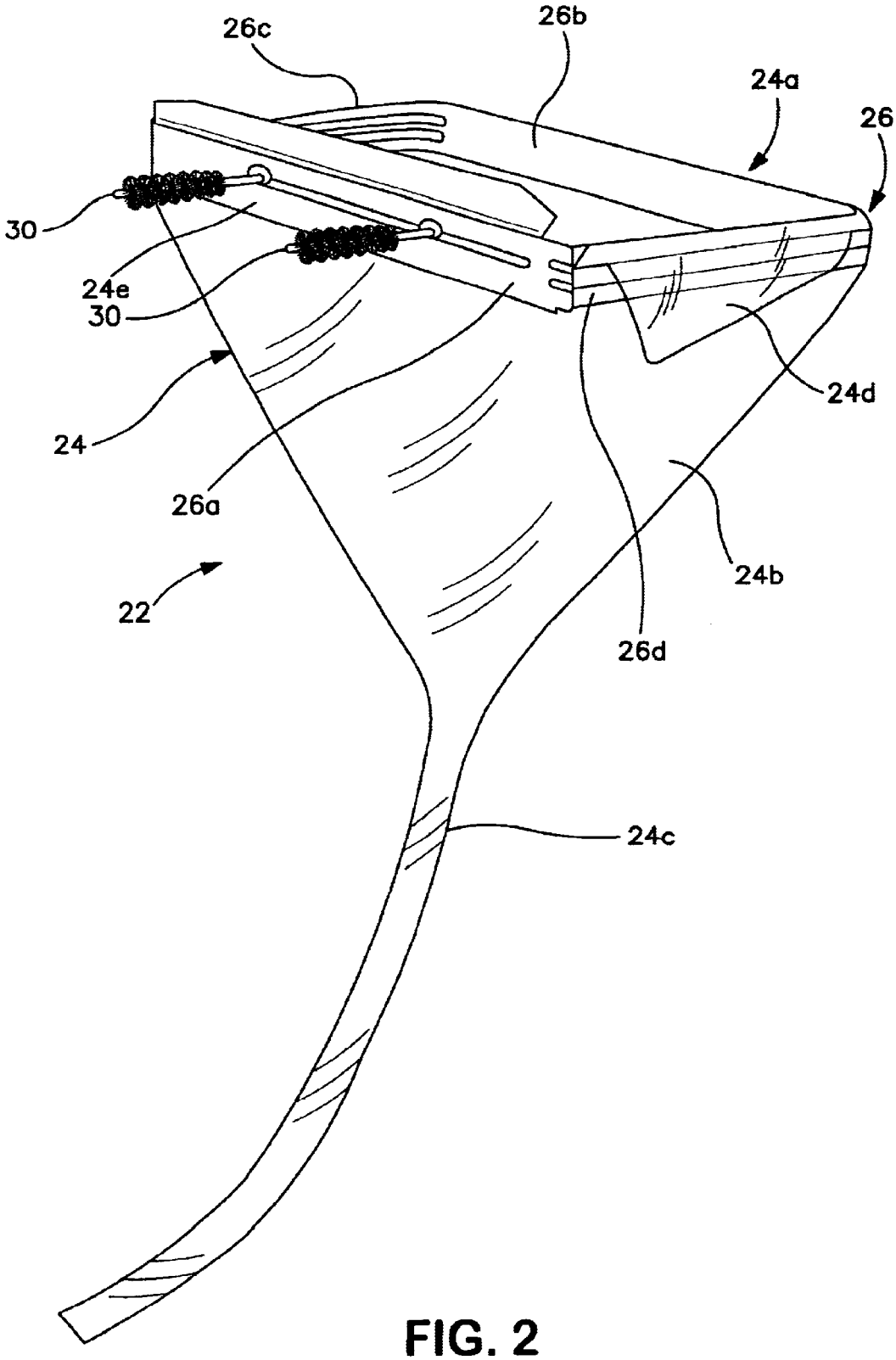
FIG. 2 is a perspective view of a collection bib and supporting frame set-up for being placed in position on a tube sheet for collecting waste-water and debris during a tube cleaning operation.
Figure 3:
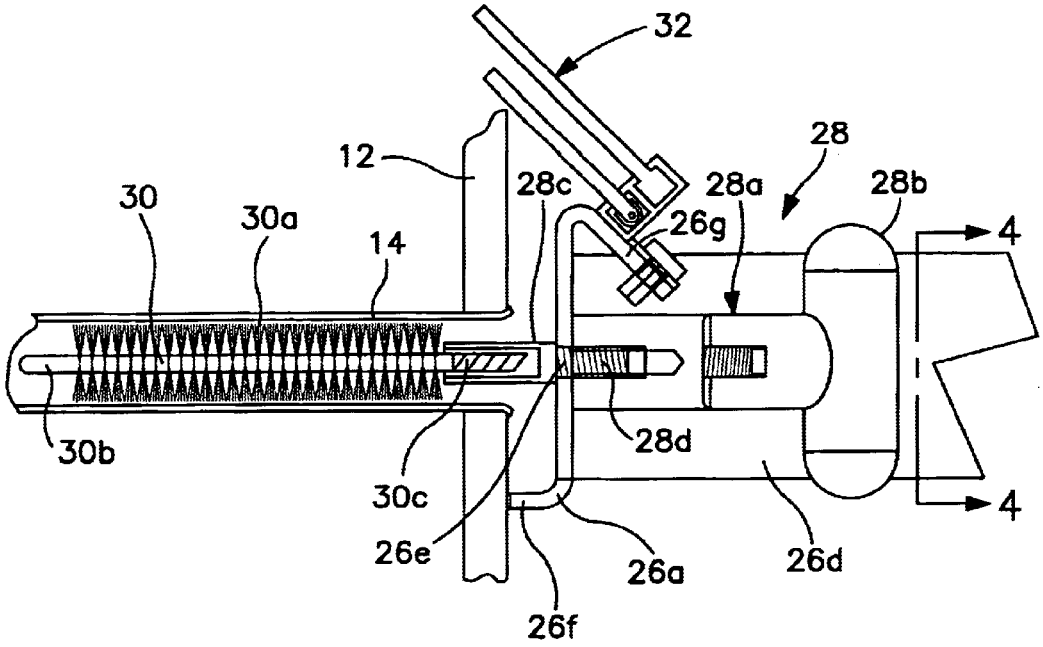
FIG. 3 is a fragmentary side elevation view partially in section of the collection bib and supporting frame of FIG. 2 in position on a tube sheet.
Figure 5:
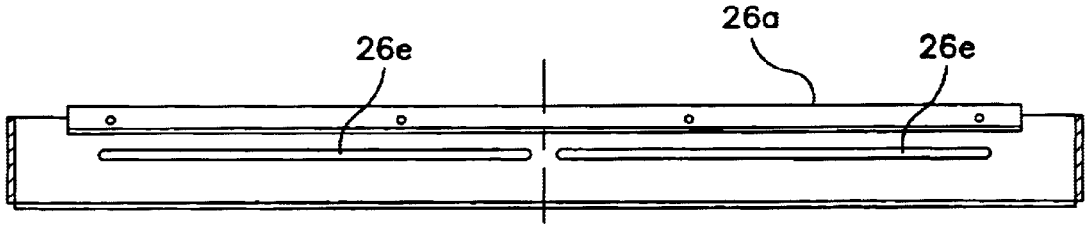
FIG. 5 is a side elevation view of the front side of the supporting frame of FIG. 2.
Figure 6:
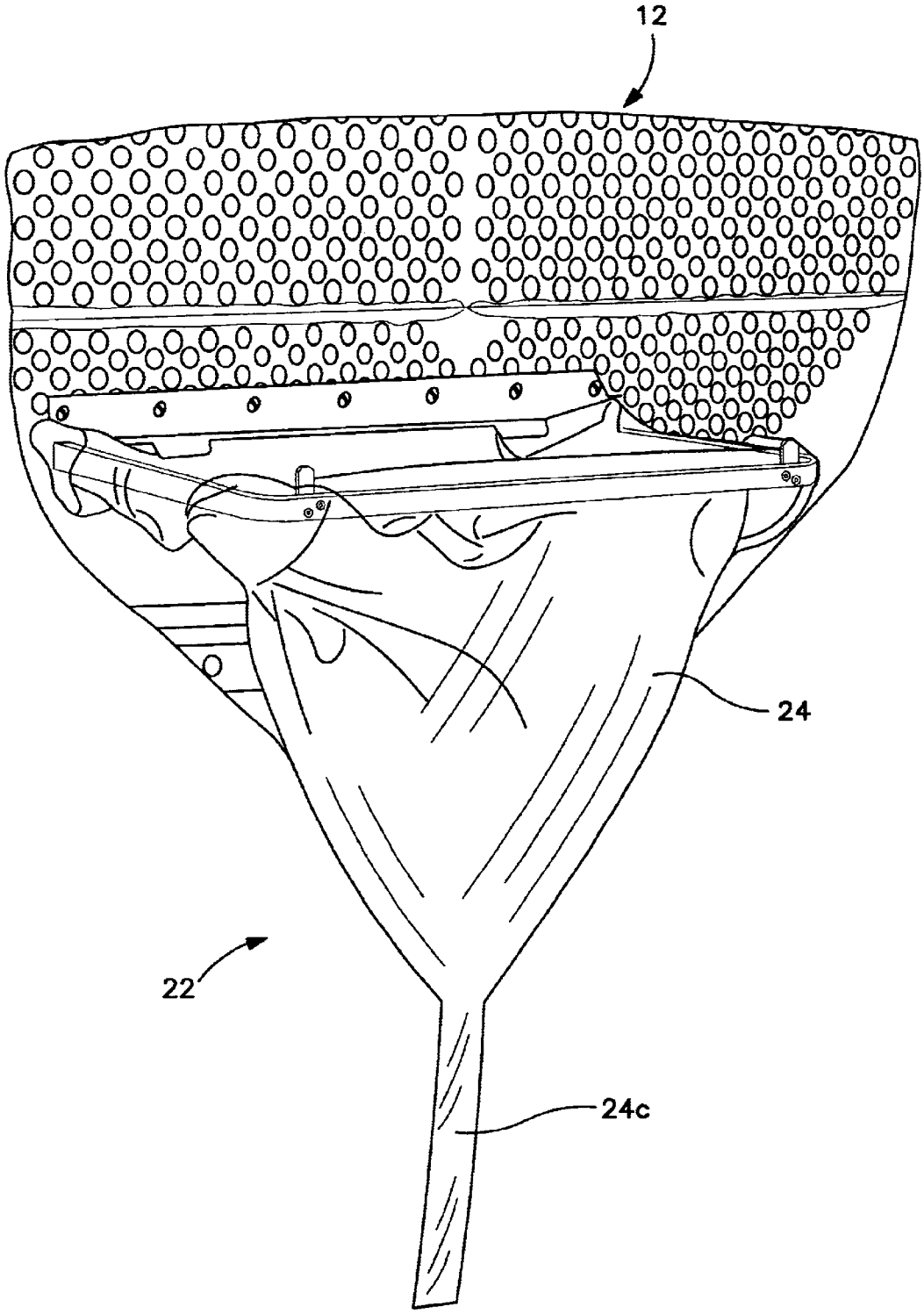
FIG. 6 is a perspective view of the collection bib and frame mounted on a tube sheet.

The supporting frame 26 is preferably rectangular in configuration and is defined by front 26*a* and rear 26*b* plates, and left 26*c* and right 26*d* side plates. As shown in FIGS. 2, 3 and 5 the front plate 26*a* includes longitudinal slots 26*e* and slide mechanisms 28 for conveniently positioning a pair of mounting arms 30 for insertion into tube ends so as to deploy the frame and bib along any given section of the tube sheet as shown in FIG. 6.

The mounting arms 30 are preferably tube cleaning brushes of a size appropriate for a cleaning tubes of a given heat exchanger. Preferably the brushes have a spiral pattern of bristles 30*a* bound by twisted wire spine 30*b* and a threaded end fitting 30*c*.

The slide mechanism 28 includes a main body 28*a*, securing handle 28*b*, and a mounting arm or brush receptacle 28*c*. The main body and brush receptacle are fitted together by a threaded link 28*d* passing through the frame slot 26*e* and may be moved along the slot to a desired position and locked in place by loosening and tightening the threaded link. Mounting brushed are fitted to the brush receptacles by a straightforward threaded connection 30*c*.

The lower edge of the front plate 26*a* (FIG. 3) has a forwardly projecting flange 26*f* that abuts a tube sheet 12 for proper positioning of the frame with respect to the tube sheet. The upper edge of the front plate has an oblique flange 26*g* for positioning a flexible blade 32 along the tube sheet as an aid in collecting tube effluent.

Figure 4:
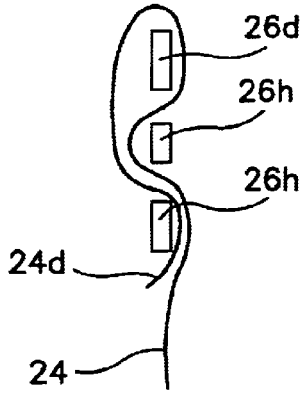
FIG. 4 is a section view taken along line 4—4 of FIG. 3.

Each of the side plates 26*c*–*d* of the frame includes a pair of slots 26*h* through which the bib triangular flaps 24*d* are threaded as shown in FIG. 4 so as to secure the bib in wide open position to the support frame.

The support frame may be fabricated of any suitable lightweight material such as aluminum, plastic and the like.

For a tube cleaning operation, a bib is fitted to the support frame and the free ends of the mounting arms are placed in tube ends so as to position the bib under a section of tube sheet selected for tube cleaning. Tubes are cleaned by passing a rotary brush and water flush into each tube. An exiting brush ejects a column of waste-water and debris into the bib. The bib passes the waste-water and debris through duct to a floor drain. The frame and bib are repositioned along the tube sheet as necessary for cleaning all of the tubes in the heat exchanger. After a cleaning operation, the bib is removed from the frame and discarded.

Figure 7:
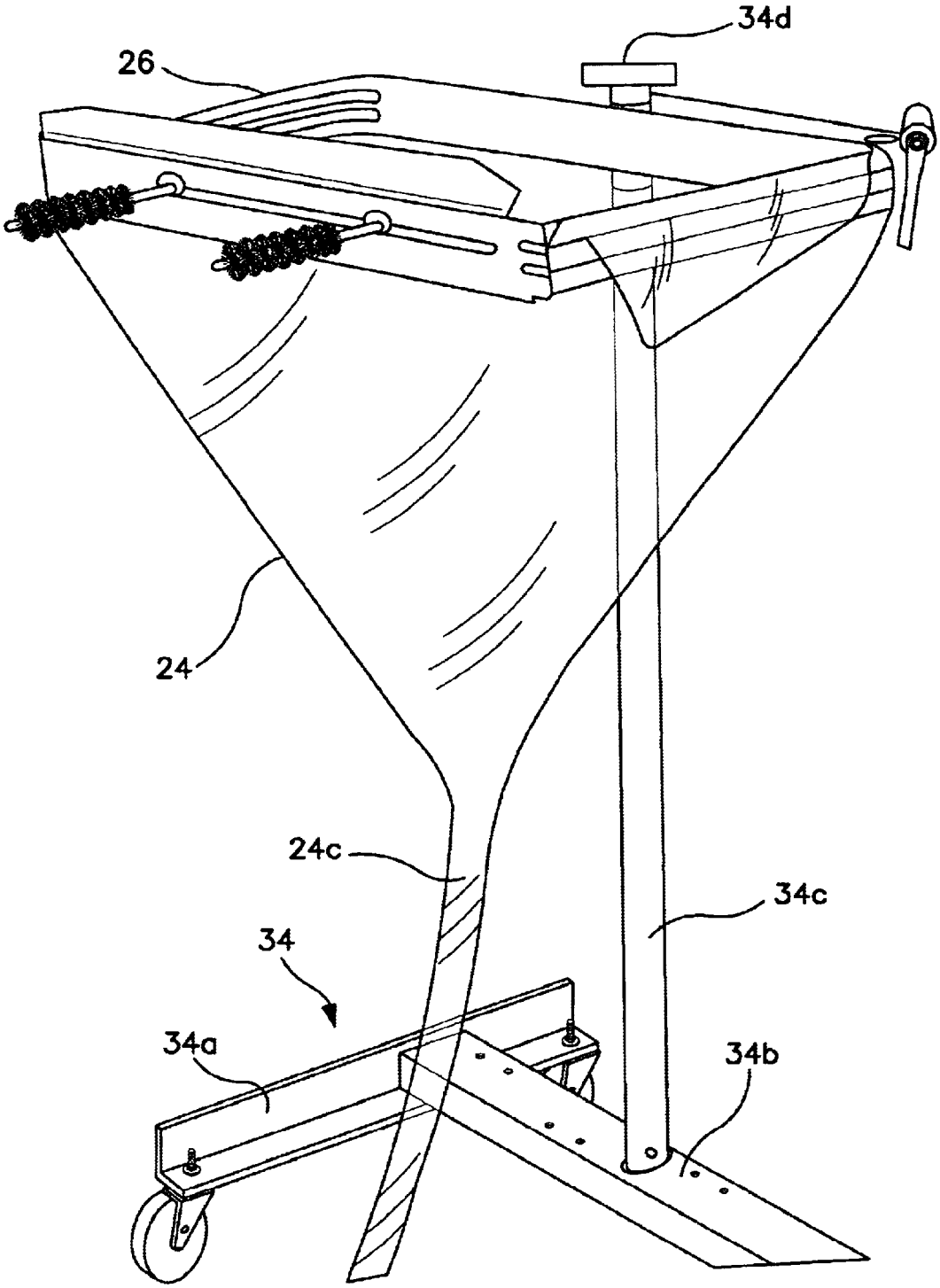
FIG. 7 is a perspective view of a modified embodiment of the invention in which a supporting frame and collection bib are carried by a portable stand for deployment as necessary to collect and dispose of leaks from a variety of sources.

FIG. 7 illustrates a modified embodiment of the invention in which the supporting frame 26 and collection bib 24 of FIGS. 1–6 is mounted to a portable stand 34 having a wheeled lower frame 34*a* with a horizontal cross-bar 34*b* and a vertical support post 34*c*. The vertical post includes a clamping device 34*d* at its upper end for receiving and securing a collection bib in its supporting frame. The stand is placed as desired to collect liquids and related debris and to direct the collected material to a suitable disposal outlet such as a floor drain through the bib outlet duct.

Figure 8:
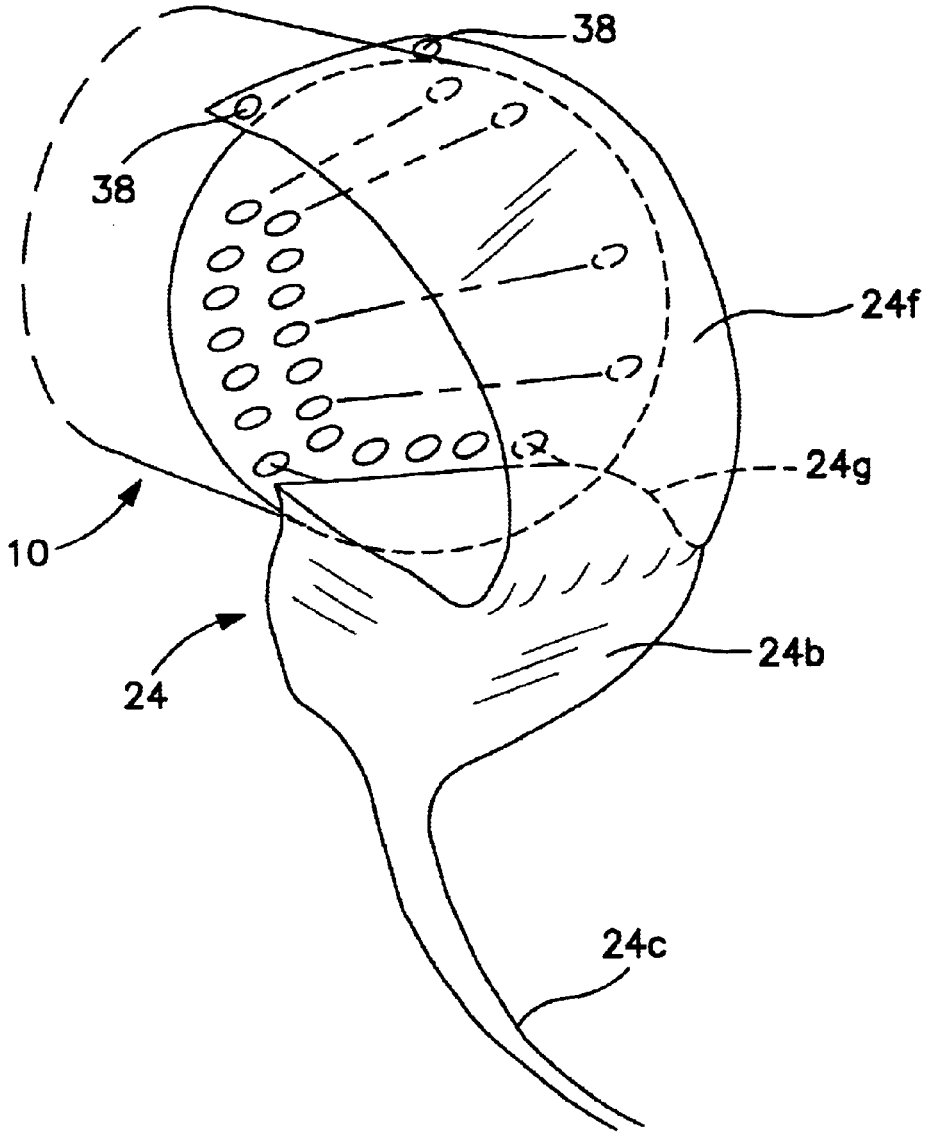
FIG. 8 is a perspective view of a modified embodiment of the invention in which a collection bib is fitted with deflector panel extending from the rim of the bib and secured to the top side of the heat exchanger for deflecting liquid and debris down into the bib.

Another modification of the invention is shown in FIG. 8 in which the collection bib 24 is provided with a deflector panel 24*f* extending from the upper rim 24*g* of the bib and secured to the top side of the heat exchanger 10 for deflecting liquid and debris down into the bib. The deflector panel is held in operating position by any suitable means 38 such as magnets or ties. This modification of the invention is primarily for use at the back side of the heat exchanger where liquid and debris are pushed out of the back end of each tube, however, the modification can also be used at the front side of the heat exchanger where an operator is cleaning tubes.

Figure 9:
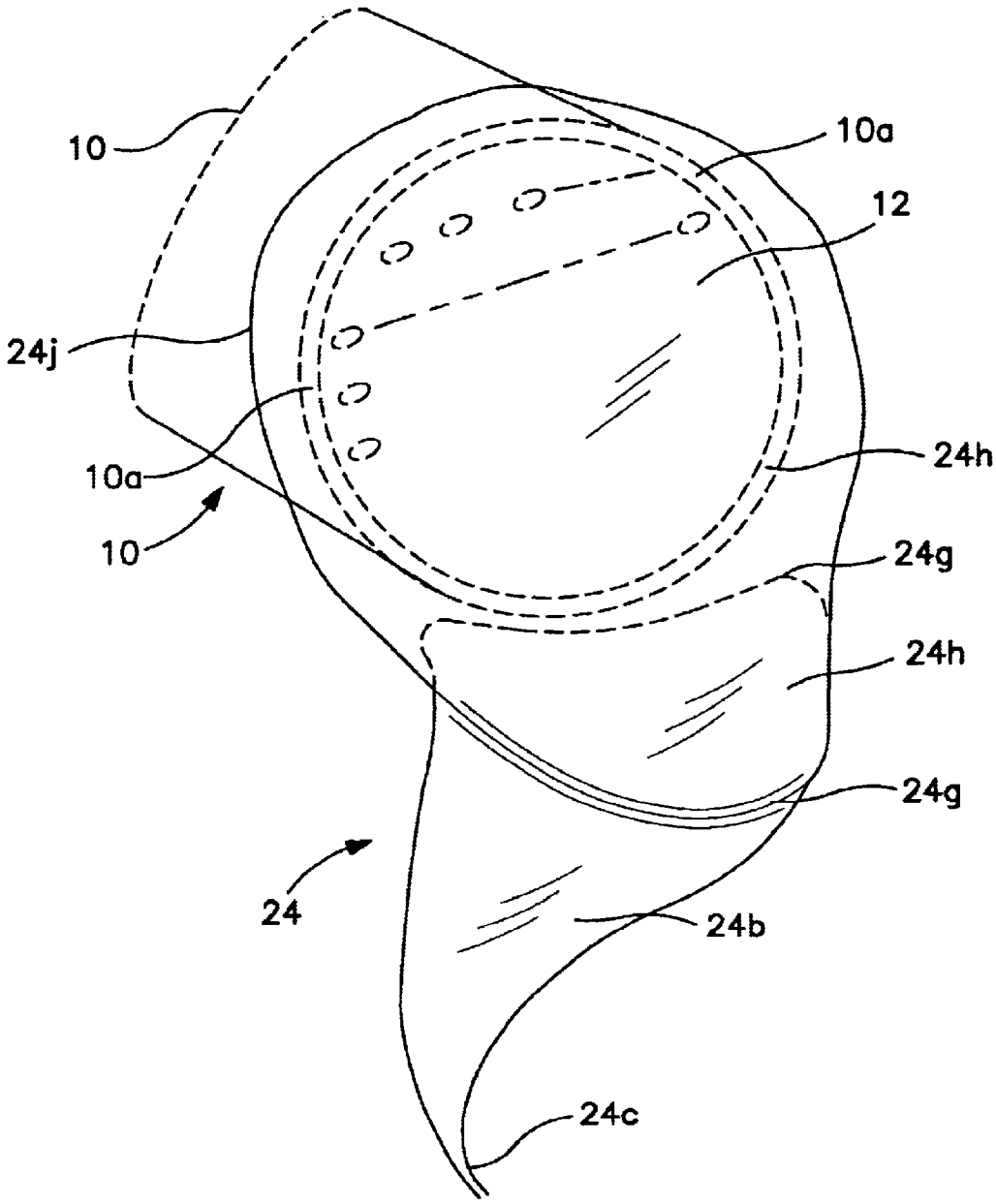
FIG. 9 is a perspective view of a modified embodiment of the invention in which a collection bib has an integral hood fitted over the top side of a heat exchanger for deflecting liquid and debris flowing from tubes down into a bib.

Another modification of the invention is shown in FIG. 9 in which a collection bib 24 is fitted with an integral deflector hood 24*h* that is fitted over an exposed tube sheet 12 for deflecting tube effluent down into the bib. The deflector hood is one-piece with the collection bib extending from bib rim 24*g* to peripheral edge 24*j* providing an impermeable hood that deflects fluid and debris down into the bib. The peripheral edge 24*j* of the deflector hood fits over the heat exchanger flange 10*a* thereby positioning the hood in operation. This modification is chiefly used at the back side of the heat exchanger.

Various changes may be made to the structure embodying the principles of the invention. The foregoing embodiments are set forth in an illustrative and not in a limiting sense. The scope of the invention is defined by the claims appended hereto.

We claim:

1. An apparatus for collection and disposal of waste-water and debris in an operation for cleaning tubes comprising a bib in the general shape of a funnel with large open end for receiving waste-water and debris from tube ends, with conical body converging to a small end terminating in an elongate duct for leading waste water and debris to a drain, a support frame for receiving and maintaining the large end of the bib in open position, the frame having a plate for positioning the bib along the tube ends, mounting arms projecting from the plate for insertion into tube ends permitting placement of the bib as desired to collect effluent from the tubes during a tube cleaning operation.

2. An apparatus as defined in claim 1 in which the mounting arms are tube cleaning brushes slidably mounted on the plate.

3. An apparatus for collection and disposal of waste-water and debris in an operation for cleaning open-ended tubes mounted between tube sheets comprising a bib in the general shape of a funnel with large open end, with conical body converging to a small end terminating in an elongate duct for leading waste water and debris to a drain, a portion of the large open end of the bib having flaps, another portion of the large open end between the flaps being in a generally straight edge for positioning under the tube sheet so as to collect ejected waste water and debris, a supporting frame having slotted side plates through which the flaps are threaded for maintaining the large end of the bib in open position, the supporting frame having mounting arms for insertion into tube ends thereby to position the bib with its straight edge beneath the tube sheet for collection of effluent from tubes in any given section of the tube sheet.

4. A method for collection waste-water and debris ejected from tubes in a tube cleaning operation comprising the steps of providing a flexible generally conical bib having a large open end and converging to a small end terminating in a drain duct, mounting the flexible bib on a supporting frame having mounting arms, inserting the mounting arms into tube ends adjacent a section of tubes to be cleaned, cleaning the tubes with a rotary brush and cleaning water, ejecting waste water and debris from the tubes, collecting ejected waste-water and debris in the bib, and passing the waste-water and debris through the duct for disposal.

5. An apparatus for collection and disposal of waste-water and debris comprising a bib in the general shape of a funnel with large open end, with conical body converging to a small end terminating in an elongate duct for leading waste water and debris to a drain, the a portion of the large open end of the bib having flaps, a supporting frame having slotted side plates through which the flaps are threaded for maintaining the large end of the bib in open position, the supporting frame being mounted moveable stand so that the bib may be moved into position for collection of effluent from leaks of various kinds.

6. A flexible impermeable bib for collection and disposal of waste fluid and debris from tubes in tube cleaning operation, the bib adapted for securement to a support frame in order to collect and dispose of fluid and debris, the bib comprising a conical body in the general shape of a funnel with large entry opening, the body converging toward and forming an elongate duct for leading fluid and debris to a sewer or drain pipe, the bib having means extending from the entry opening for securing the bib to a supporting frame which sets up and maintains the large end of the bib in wide open position.

7. A bib as defined in claim 6 in which the means for securing the bib comprise flaps extending from the large end of the bib.

8. A bib as defined in claim 6 which has an upper rim, a deflector panel extending from the upper rim, and means for securing the deflector panel in operating position for deflecting fluid and debris down into the bib.

9. A bib as defined in claim 6 having integral deflector hood for deflecting fluid and debris down into the bib.

* * * * *